US005785777A

United States Patent [19]

Cantrell et al.

[11] Patent Number: 5,785,777

[45] Date of Patent: Jul. 28, 1998

[54] METHOD OF MAKING AN AA7000 SERIES ALUMINUM WROUGHT PRODUCT HAVING A MODIFIED SOLUTION HEAT TREATING PROCESS FOR IMPROVED EXFOLIATION CORROSION RESISTANCE

[75] Inventors: Mark Alan Cantrell, Rockville; Kevin Richard Anderson, Richmond; Kim Herbert Archibald, Chesterfield, all of Va.

[73] Assignee: Reynolds Metals Company, Richmond, Va.

[21] Appl. No.: 755,082

[22] Filed: Nov. 22, 1996

[51] Int. Cl.[6] ..... C22C 21/00

[52] U.S. Cl. ..... 148/694; 148/694; 148/697; 148/698; 148/690

[58] Field of Search ..... 148/694, 697, 148/698, 690

[56] References Cited

U.S. PATENT DOCUMENTS

| | | | |
|---|---|---|---|
| 3,305,410 | 2/1967 | Sublett et al. | 148/159 |
| 3,573,117 | 3/1971 | Cocks | 148/159 |
| 4,305,763 | 12/1981 | Quist et al. | 148/12.7 |
| 4,477,292 | 10/1984 | Brown | 148/20 |
| 4,828,631 | 5/1989 | Ponchel et al. | 148/417 |
| 4,832,758 | 5/1989 | Brown | 148/12.7 |
| 4,863,528 | 9/1989 | Brown et al. | 148/12.7 |
| 4,946,517 | 8/1990 | Cho | 148/12.7 |
| 4,954,188 | 9/1990 | Ponchel et al. | 148/417 |
| 5,108,520 | 4/1992 | Liu et al. | 148/12.7 |
| 5,221,377 | 6/1993 | Hunt, Jr. et al. | 148/417 |

*Primary Examiner*—David A. Simmons
*Assistant Examiner*—M. Alexandra Elve
*Attorney, Agent, or Firm*—Alan M. Biddison

[57] ABSTRACT

A method of producing an AA7000 series aluminum alloy wrought product or plate includes a two step solution heat treating sequence wherein the aluminum plate is subjected to a first solution heat treatment at a first elevated temperature or temperatures for a first period of time, followed by a second solution heat treatment at a lower temperature or temperatures for a second period of time. The two step solution heat treating sequence results in vastly improved exfoliation corrosion resistance in the final aluminum wrought or plate product. An improved process for making aluminum alloy products in the T7751 Temper also is disclosed.

18 Claims, 2 Drawing Sheets

METHOD OF MAKING AN AA7000 SERIES ALUMINUM WROUGHT PRODUCT HAVING A MODIFIED SOLUTION HEAT TREATING PROCESS FOR IMPROVED EXFOLIATION CORROSION RESISTANCE

FIELD OF THE INVENTION

The present invention is directed to an improved solution heat treating process for AA7000 series aluminum plate products and, in particular, to a two step solution heat treating process utilizing a higher temperature solution heat treating first step and a lower temperature solution heat treating second step for improved exfoliation corrosion resistance.

BACKGROUND ART

Aluminum alloys of the Aluminum Association ("AA") 7000 series which contain relatively high amounts of zinc, as well as magnesium and copper, are used extensively in commercial and military aircraft applications. These alloys are desired due to their high strength-to-weight ratios and are often used in critical load-bearing structural components such as upper wing skins and bulk heads. In these applications, these alloys can be subjected to environments which may cause severe corrosion, e.g., exfoliation or stress corrosion cracking. Due to the requirements of these applications, it is desired that these 7000 series aluminum alloys possess superior corrosion resistance.

One conventional method of improving the corrosion resistance of these types of alloy is to modify the aging practice thereof. Typically, these alloys, after solution heat treatment at temperatures at or above 890° F. (477° C.), are subjected to a T temper artificial aging process to develop mechanical and corrosion resistance properties. When an established practice is followed this material is considered to be in a usable temper. Examples of this type of aging practice are disclosed in U.S. Pat. Nos. 4,828,631 and 4,954,188 to Ponchel et al. In these patents, an aging practice is disclosed wherein the aluminum alloy material is aged within a temperature of about 265° F. (129° C.) to 290° F. (143° C.) for about six to sixty hours to a peak strength condition. This aging is typically designated as a T6151 temper.

Although Ponchel et al. assert that such an aging practice improves exfoliation corrosion resistance, the level of corrosion resistance still fails to meet many of the more demanding requirements of some aircraft manufacturers. Longer aircraft design lifetimes, particularly in coastal marine environments, require exfoliation corrosion resistance above and beyond what the -T6151 temper typically provides.

Also, known is the T7751 temper aging process used with AA7150 alloys. This temper can be produced using a 3-step artificial aging practice of the type described in one or more of U.S. Pat. No. 4,477,292, titled THREE-STEP AGING TO OBTAIN HIGH STRENGTH AND CORROSION RESISTANCE IN AL-ZN-MG-CU ALLOYS, issued Oct. 16, 1984; U.S. Pat. No. 4,832,758, titled PRODUCING COMBINED HIGH STRENGTH AND HIGH CORROSION RESISTANCE IN AL-ZN--MG-CU ALLOYS, issued May 23, 1989; U.S. Pat. No. 4,863,528, titled ALUMINUM ALLOY PRODUCT HAVING IMPROVED COMBINATIONS OF STRENGTH AND CORROSION PROPERTIES AND METHOD FOR PRODUCING THE SAME, issued Sep. 5, 1989; U.S. Pat. No. 5,108,520, titled HEAT TREATMENT OF PRECIPITATION HARDENING ALLOYS, issued Apr. 28, 1992; and U.S. Pat. No. 5,221,377, titled ALUMINUM ALLOY PRODUCT HAVING IMPROVED COMBINATIONS OF PROPERTIES, issued Jun. 22, 1993; the contents of each of the preceding being herein incorporated by reference.

The T7751 process provides a product having a longitudinal (L) tensile strength of at least 84 ksi, a (L) yield strength of at least 78 ksi, and (L) elongation of at least 8%. Long Transverse (LT) properties are a minimum tensile strength of at least 84 ksi, a minimum yield strength of at least 77 ksi, and a minimum elongation of 8%. In addition, the product must pass a stress corrosion cracking test conducted according to ASTM Test Method G47 with alternate immersion (per ASTM Practice G44) at 25 ksi for 20 days.

Therefore based on more stringent design criteria, particularly with regard to long term aircraft operations, a need has developed to provide an aluminum plate material having improved exfoliation corrosion resistance while still meeting the other mechanical and/or physical properties required by aircraft manufacturers.

The present invention responds to this need and provides a method of making AA7000 series aluminum alloy plate which provides not only a vastly improved exfoliation corrosion resistance but also mechanical and/or physical properties which meet or exceed required standards.

SUMMARY OF THE INVENTION

Accordingly, a first object of the present invention is to provide a method of enhancing the exfoliation corrosion resistance of AA7000 series aluminum alloy plate products.

Another object of the present invention is to provide an AA7000 series aluminum alloy plate product which has both improved exfoliation corrosion resistance and desirable mechanical and physical properties to permit use of the plate product in aircraft and similar type applications.

A still further object of the present invention is to provide a method which utilizes a two step solution heat treating sequence to provide improved exfoliation corrosion resistance in the final plate product.

Yet another object is to provide an improved process for making AA7150, AA7050 and AA705X ("AA7X5X") products in the T7751 Temper.

Other objects and advantages of the present invention will become apparent as a description thereof proceeds.

In satisfaction of the foregoing objects and advantages, the present invention provides an improvement compared to prior art methods of producing AA7000 series aluminum alloy plate products. Conventionally, these plate products are produced by casting and shaping an AA7000 series aluminum alloy material into a plate product followed by solution heat treating, quenching and artificial aging. According to the invention described herein, the prior art solution heat treating process is modified from a single high temperature heat treating process to a dual or two step process wherein the plate or other wrought product is first subjected to high temperature solution heat treatment followed by a second lower temperature solution heat treatment. More specifically, the aluminum plate product to be solution heat treated is first heated to a temperature in a first range between about 885° and 910° F. (474°–488° C.) and held for a first period of time followed by a second heat treating step wherein the plate is subjected to a temperature within a second range between 825° F. and 870° F. (441°–466° C.) and held for a second time period. This two step heat treating process results in improved exfoliation corrosion resistance in the final plate product. A rapid quenching step, such as cold water quenching, can be interposed between the two solution heat treating steps, as well as after the lower temperature heat treating step.

More preferably, the second step of the solution heat treating sequence, either directly following the first step or following cooling and reheating, heats the plate at a temperature of one of about 825° F. (441° C.) for at least 15 hours, about 860° F. (460° C.) for at least 6 hours and about 870° F. (466° C.) for at least 15 hours.

The two step solution heat treating sequence results in the formation of grain boundary precipitates that are larger in size than those precipitates formed when the same material would be subjected to only the first step of the two step sequence. It is believed that the larger grain boundary precipitates contribute to the exfoliation resistance of the final plate product.

The method is preferably practiced using an AA7150 aluminum alloy or one comprising, in weight percent, a maximum of 0.12 Si, a maximum of 0.15 Fe, about 1.9 to 2.5 Cu, a maximum of 0.01 Mn, about 2.0 to 2.7 Mg, a maximum of 0.04 Cr, about 5.9–6.9 Zn, a maximum of 0.06 Ti, a maximum of 0.005 Be, about 0.08 to 0.15 Zr, with the balance aluminum and incidental impurities.

BRIEF DESCRIPTION OF THE DRAWINGS

Reference is now made to the drawings of the invention wherein.

DESCRIPTION OF THE PREFERRED EMBODIMENTS

According to the inventive method, a two step solution heat treating sequence is performed on an AA7000 series aluminum alloy plate to provide improved exfoliation corrosion resistance. Quite surprisingly, subjecting these types of aluminum alloy plates to a two step solution heat treating sequence, wherein the aluminum plate is heated to a first temperature and held for a set period of time and then subsequently heated at a second lower temperature and held for a another set period of time, results in vastly improved exfoliation corrosion resistance. Prior art solution heat treating practice wherein the aluminum alloy plate was subjected to a one step heat treating process without a second lower temperature during the solution heat treating failed to achieve comparable exfoliation corrosion resistance in the final product.

In conjunction with the improved exfoliation corrosion resistance evidenced by practicing the inventive method, the aluminum alloy plate product still exhibits acceptable mechanical and physical properties and fracture toughness.

Figure 1:
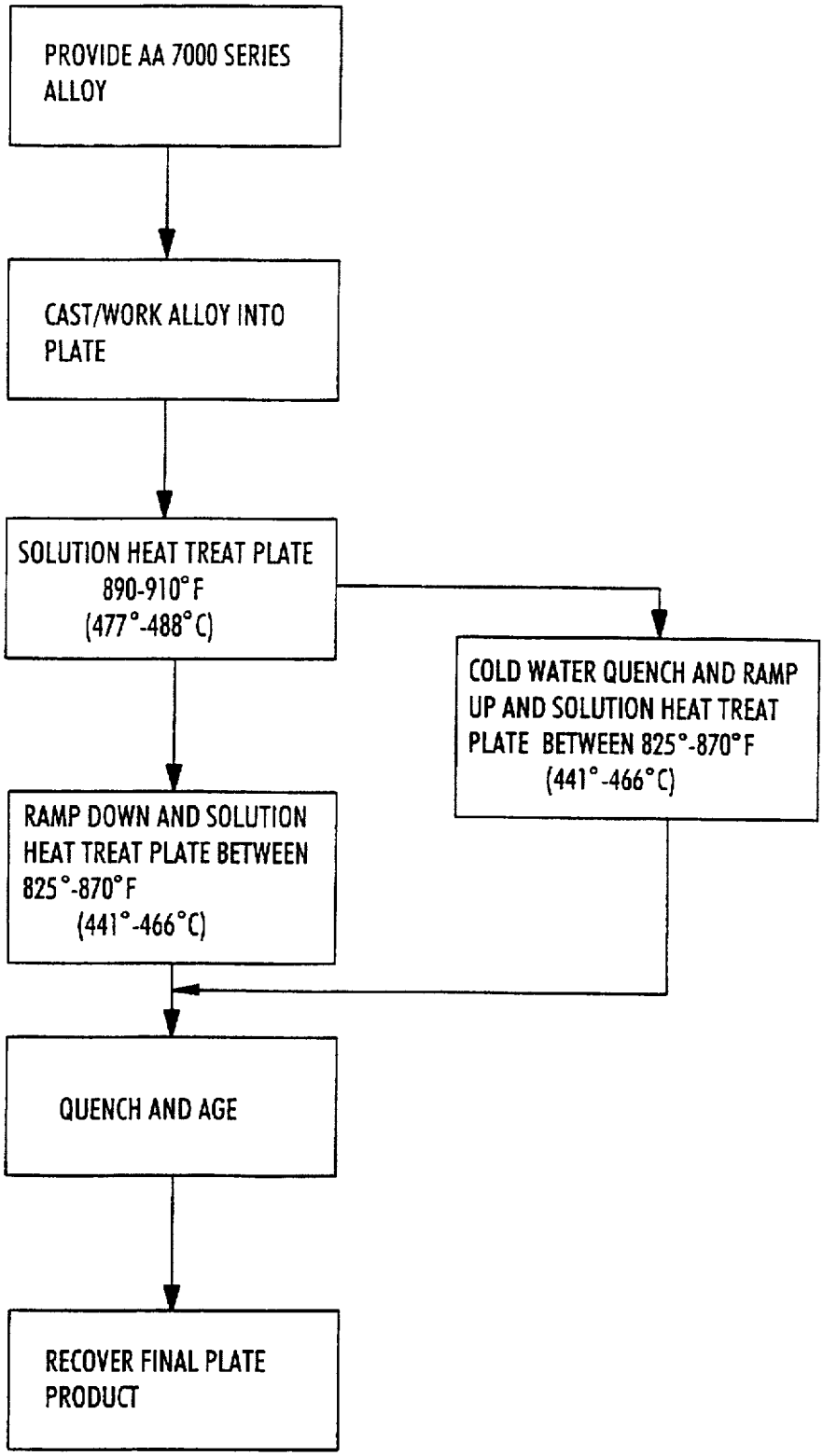
FIG. 1 is a schematic flow diagram showing the inventive processing.

Referring now to FIG. 1, a schematic diagram broadly describes the overall processing of an AA7000 series alloy into a plate product. The AA7000 series alloy is first cast and subsequently worked into a plate using conventional practice. The plate then could be shaped into a part. The term "plate" includes both a rolled product and a part formed from the rolled product prior to solution heat treating. The invention also is useful with processing of other forms of wrought products, such as forgings and extrusions. After the aluminum alloy is formed into a plate or other wrought product, it is subjected to a two step solution heat treating process wherein the plate is heated to a temperature in a first temperature range between about 885°–910° F. (474°–488° C.), held within the first temperature range for a desired time period, cooled to a temperature within a second temperature range between about 825° and 870° F. (441°–466° C.), and held within the second temperature range for a desired time period.

The solution heat treated plate is then quenched, preferably with ambient or colder temperature water, stretched and aged, as is conventionally done in the processing of aluminum plate, followed by recovery of the final plate product for a specific end use. For instance the product may be subject to multiple step aging practice to develop the aforementioned T7751 Temper. Use of the two step solution heat treating process can both extend the aging process windows for developing T7751 properties and improve the properties of the product, either of which is considered an improvement.

The time the plate or other wrought product is held at the first higher temperature or within the first higher temperature range of the solution heat treating process can range up to about eight hours, preferably up to about six hours and more preferably up to about three hours, the holding time at least in part depending on the temperature selected. If a higher temperature is selected, such as 910° F. (488° C.), a shorter time would be required than if a lower temperature was selected, such as 885° F. (474° C.).

Concerning the second step of the two step solution heat treating process, the holding time at a lower temperature or within the lower temperature range could be as long as 24 hours. As will be described in more detail below, preferred times range from about 6 to about 15 hours.

It is believed that any AA7000 series alloy adapted for plate or other wrought product production can be processed according to the inventive method. More preferably, the AA7000 series alloy is an AA7150 alloy. Alternatively, the alloy to be processed could have the composition used in the experiments discussed below.

The subsequent aging practice for the alloy can also vary as is known in the art. When processing an AA7150 alloy, a -T6151 temper is preferred. Other T6 tempers could also be utilized such as T651, as well as T7 tempers, such as T7751.

Figure 2:
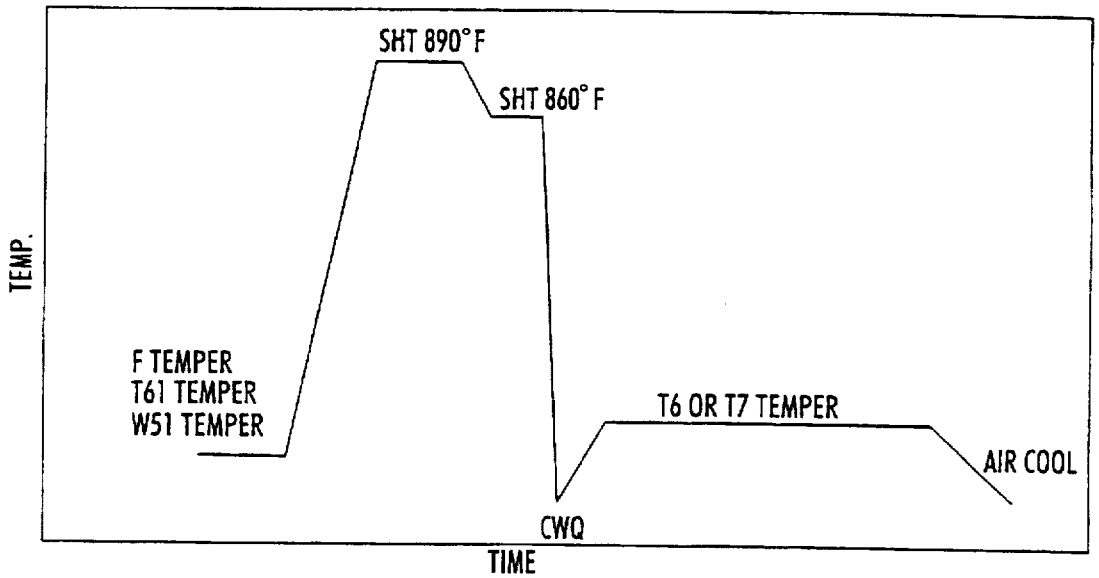
FIG. 2 is a time-temperature profile showing an exemplary ramp solution heat treating sequence of the inventive method.
Figure 3:
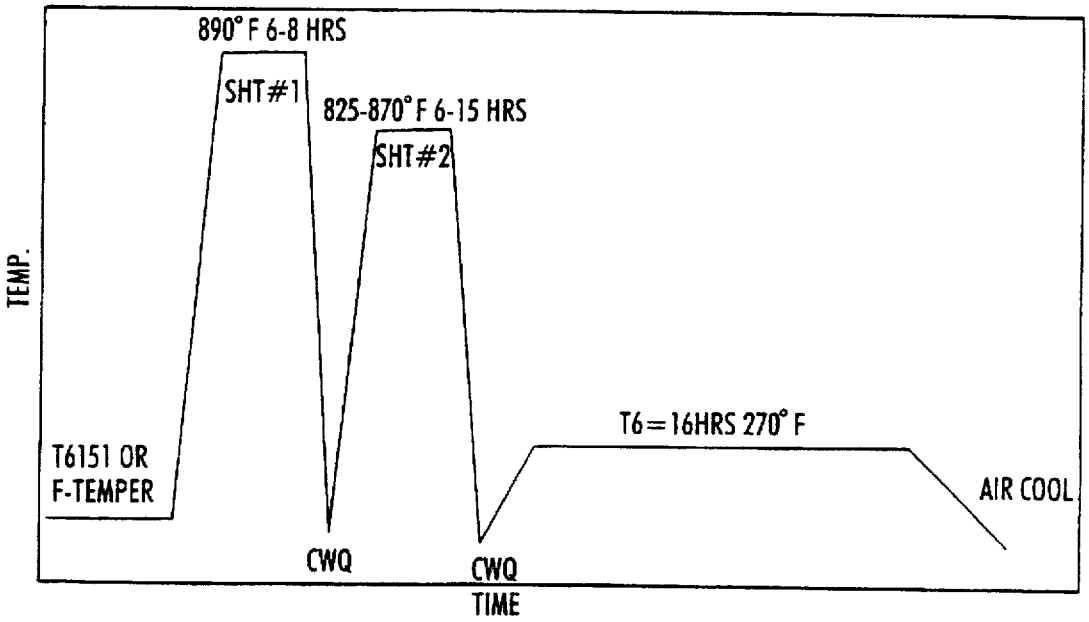
FIG. 3 is a time-temperature profile showing an alternative solution heat treating sequence to that shown in FIG. 2.

Referring now to FIGS. 2 and 3, exemplary solution heat treating practices are depicted. In FIG. 2, a heat treating practice is disclosed similar to that shown in FIG. 1. This figure also demonstrates that the plate to be solution heat treated could be in the -F, -T61 or W51 temper prior to practice of the invention. The temper of the plate prior to practicing the inventive method does not influence the utility of the invention. Therefore the inventive method can be used to reprocess plate, which had unacceptable exfoliation corrosion resistance when processed conventionally, thereby resulting in acceptable material. This figure also indicates that the plate to be solution heat treated has a rapid ramping up to the first solution heat treating temperature of 890° F. (477° C.), a hold at the first temperature for about 3 hours, followed by a ramp or cool down to the second solution heat treating temperature of 860° F. (460° C.), a hold at the second temperature for about 6 hours, followed by a cold water quench and artificial aging to a T6 temper. A T7 temper could also be used.

As an alternative to the two step process disclosed in FIGS. 1 and 2, a cold water quench can be inserted after the first step of the two step solution heat treating process. Referring now to FIG. 3, the two step solution heat treating sequence is depicted with a cold water quench following each of the two solution heat treatments. As illustrated in this drawing, a -T6151 or F-temper plate is used for the first solution heat treating sequence, followed by a cold water quench, and then ramp up to the second solution heat treating temperature which is then followed by a cold water quench and aging to a -T6 temper. As will be described below, superior exfoliation corrosion resistance is achieved with both of the solution heat treating sequences depicted in FIGS. 2 and 3.

To demonstrate the unexpected results obtained with the inventive heat treating sequence, a series of experiments were conducted to compare conventional solution heat treating of AA7000 series aluminum alloy plate with the solution heat treating sequence of the invention. It should be understood that the experiments discussed below are presented to further illustrate the invention and are not deemed to be limiting in terms of the invention scope or breadth.

One objective of the experiments was to determine what effect, if any, an initial temper had on final exfoliation corrosion resistance properties when the inventive solution heat treating sequence was practiced.

As part of the experiment, samples were provided in the F, W51 and T6151 tempers from a plate having the following composition in wt. %: 0.03 Si, 0.05 Fe, 2.34 Cu, 0.01 Mn, 2.01 Mg, 0.01 Cr, 6.63 Zn, 0.03 Ti, 0.008 Va, 0.11 Zr, with the balance aluminum and incidental impurities.

Samples with the above-identified composition were heat treated for three hours at 890° F. (477° C.), followed by reducing or ramping the temperature down to 860° F. (460° C.). The samples were held at the 860° F. (460° C.) temperature for 6, 9, 15 and 24 hours. These samples were then cold water quenched and aged to a -T6151 temper. Duplicate specimens were prepared for each sample.

When investigating the exfoliation corrosion resistance properties of this heat treatment, as well as mechanical properties, duplicate 0.505" (1.28 cm) diameter (4D) tensile specimens of the treated materials were made and tested in the longitudinal (L) direction to establish tensile strength, yield strength and elongation properties. Duplicate 2"×4" (5.08×10.16 cm) exfoliation (EXCO) samples were tested for each time specified above.

Table 1 details the EXCO ratings and mass loss for each of the experimental conditions above. The samples were all aged to a -T61 temper prior to testing. Also shown in Table 1 is the EXCO rating of EC for the conventionally processed (standard) T6151 plate. As is clearly evident from Table 1, an excellent exfoliation corrosion resistance rating of EA was obtained for all initial tempers and all time periods. The table demonstrates the unexpected results associated with using the inventive two step solution heat treating sequence in place of the conventional practice of heating the plate at a 890° F. (477° C.) temperature or above for a given period of time. This example serves to illustrate the utility of the invention in the reprocessing of plate which has unacceptable exfoliation corrosion resistance when processed conventionally. The inventive method can be used to recover plate which would otherwise be scrapped due to unacceptable exfoliation corrosion resistance, thereby resulting in an obvious economic benefit.

TABLE 1

EXCO Ratings and calculated Mass Losses

| Initial Temper | SHT Time @ 860° F. (460° C.) (hours) | G34-90* | G34-72* | Mass Loss mg/in²/ mg/cm² |
|---|---|---|---|---|
| T6 | 6 | EA | EA | 85/13 |
| T6 | 6 | EA | EA | 86/13 |
| T6 | 9 | EA | EA | 105/16 |
| T6 | 9 | EA | EA | 116/18 |
| T6 | 15 | EA | EA | 108/17 |
| T6 | 15 | EA | EA | 96/15 |
| T6 | 24 | EA | EA | 92/14 |
| T6 | 24 | EA | EA | 110/17 |
| F | 6 | EA | EA | 66/10 |
| F | 6 | EA | EA | 68/11 |
| F | 9 | EA | EA | 197/31 |
| F | 9 | EA | EA | 122/19 |
| F | 15 | EA | EA | 101/16 |
| F | 15 | EA | EA | 87/13 |
| F | 24 | EA | EA | 112/17 |
| F | 24 | EA | EA | 112/17 |
| W51 | 6 | EA | EA | 73/11 |
| W51 | 6 | EA | EA | 80/12 |
| W51 | 9 | EA | EA | 109/17 |
| W51 | 9 | EA | EA | 117/18 |
| W51 | 15 | EA | EA | 70/11 |
| W51 | 15 | EA | EA | 74/11 |
| W51 | 24 | EA | EA | 73/11 |
| W51 | 24 | EA | EA | 73/11 |
| Standard T6151 Plate Average | | EC | EB | 400–600/ 62–93 |

SHT = Solution Heat Treat
*ASTM Exfoliation Rating Standards

Table 2 compares the mechanical properties of the samples treated with the inventive solution heat treating sequence described above, after aging to a -T61 temper, with a standard T6151 plate average. Table 2 shows that the mechanical properties of the plate produced with the inventive method were slightly below that for the T6151 plate average. It is believed that the difference between the F initial temper and the T6 and W51 tempers was due to the fact that the F temper plate lacked a 2% stretch, which was given to each of the T6 and W51 initial temper plates.

In Table 2, a first step solution heat treatment ("SHT") of 3 hours at 890° F. (477° C.) was followed by a second step SHT at 860° F. (460° C.) for the indicated number of hours.

TABLE 2

Mechanical Properties
1st Step SHT of 3 hours @ 890° F. (477° C.)

| Initial Temper | 2d SHT Time | Tensile ksi/MPa | Yield ksi/MPa | Elongation (%) |
|---|---|---|---|---|
| T6 | 6 | 91.3/629 | 84.0/579 | 13.0 |
| T6 | 6 | 91.1/628 | 83.6/576 | 14.0 |
| T6 | 9 | 91.8/633 | 84.2/580 | 15 |
| T6 | 9 | 91.8/633 | 84.0/579 | 15 |
| T6 | 15 | 91.5/630 | 83.9/578 | 15 |
| T6 | 15 | 92.2/635 | 84.1/579 | 14.5 |
| T6 | 24 | 91.2/628 | 83.8/577 | 14.5 |
| T6 | 24 | 91.2/628 | 83.8/577 | 14.5 |
| F | 6 | 90.5/624 | 82.8/570 | 14.5 |
| F | 6 | 90.5/624 | 82.7/570 | 14.5 |
| F | 9 | 90.8/626 | 82.5/362 | 14.5 |
| F | 9 | 90.7/625 | 82.8/570 | 14.5 |
| F | 15 | 91.1/628 | 83.1/573 | 14.0 |
| F | 15 | 91.4/630 | 83.3/574 | 13.5 |
| F | 24 | 89.5/617 | 82.5/568 | 13.5 |
| F | 24 | 89.6/617 | 82.1/566 | 14.5 |
| W51 | 6 | 91.8/633 | 83.9/578 | 14.5 |

TABLE 2-continued

| Mechanical Properties 1st Step SHT of 3 hours @ 890° F. (477° C.) | | | | |
|---|---|---|---|---|
| Initial Temper | 2d SHT Time | Tensile ksi/MPa | Yield ksi/MPa | Elongation (%) |
| W51 | 6 | 91.7/632 | 84/579 | 13.5 |
| W51 | 9 | 91.7/632 | 83.9/578 | 14 |
| W51 | 9 | 91.8/633 | 84/579 | 14 |
| W51 | 15 | 91.5/630 | 83.9/578 | 15 |
| W51 | 15 | 92.2/635 | 84.1/579 | 14.5 |
| W51 | 24 | 91.5/630 | 84/579 | 14.5 |
| W51 | 24 | 91.6/631 | 84/579 | 13.5 |
| Standard T6151 Plate Average | | 90.7/625 | 85.0/586 | 12.7 |

Experiments were also conducted following the solution heat treating practice depicted in FIG. 3 discussed above. In these studies, an AA7150 aluminum alloy plate was subjected to a two step solution heat treating sequence including 6 hours at 890° F. (477° C.) followed by direct cold water quench and a subsequent solution heat treating sequence at temperatures of 825° F., 860° F. and 870° F. (441° C., 460° C. and 466° C.), respectively, and time increments of 0, 2, 3, 6, 9, 15 and 24 hours. The second step heat treatment was followed by a cold water quench and a standard -T61 aging practice of 16 hours at 270° F. (132° C.) and air cooling. In this test work, a clear pattern of EA exfoliation corrosion resistance results was seen. For example, all samples aged for 15 hours at 825° F. (441° C.), 6 hours at 860° F. (460° C.) or 15 hours at 870° F. (466° C.) demonstrated EA ratings for exfoliation corrosion resistance.

With the improved exfoliation corrosion resistance using two cold water quenching steps, mechanical properties for tensile strength, yield strength and elongation also were commercially acceptable.

The study of the two step solution heat treating sequence using a cold water quench between the two steps provides not only an unexpected improvement in exfoliation corrosion resistance when including a lower temperature second step solution heat treating step but also establishing that a cold water quench between the two solution heat treating steps is optional. That is, EA ratings were achieved when merely ramping down to the second step solution heat treating without a cold water quench.

Microstructural studies were conducted of AA7150 plate to investigate the phenomena which may contribute to the superior exfoliation corrosion resistance found in plate samples given the two step solution heat treating sequence.

During these studies, it was discovered that samples given a first higher temperature solution heat treatment and an 860° F. (468° C.) solution heat treatment second step had large copper-bearing precipitates (S-Phase) at the grain boundaries. Samples heat treated only in the 890°–910° F. (477°–488° C.) range had zinc-bearing grain boundary precipitates that were one to two orders of magnitude smaller in size. The size and chemistry of these grain boundaries precipitates appeared to correlate with the material's exfoliation corrosion resistance. That is, the solution heat treated plates having the larger size, high copper precipitates had superior exfoliation corrosion resistance when compared with the material having zinc-bearing, smaller size precipitates.

It is believed that the lower temperature, e.g., 860° F. (468° C.), solution heat treatment second step caused the nucleation and growth of S phase precipitates at the grain boundaries. At least two mechanisms are believed to be responsible for this improvement. First, the S-phase precipitates may be depleting the grain boundary and the surrounding matrix of solute and may enhance the corrosion resistance behavior of the alloy. The S-phase precipitates may change the potential of the grain boundary with respect to the matrix and may shift the mode of corrosion attack from the grain boundaries to the matrix. During these studies, the same composition was tested for the two step solution heat treating with the interposed cold water quench.

Experiments were also conducted to determine whether fracture toughness was adversely affected by the two step solution heat treatment.

The results of these studies showed that fracture toughness minimums of 22 ksi $(\text{inch})^{1/2}$ in the LT direction and 20 ksi $(\text{inch})^{1/2}$ in the T–L direction were met. More specifically, an average $K_1c$ of 32 ksi $(\text{inch})^{1/2}$ in the L–T direction and 36 ksi $(\text{inch})^{1/2}$ in the T–L direction were achieved which is substantially above minimum requirements. The alloy composition studied was that referenced above in connection with the microstructure investigation.

In another example according to the present invention, AA7150 alloys having compositions comparable to that of the samples used in the previously described examples first were given the inventive two step solution heat treatment and then were subjected to a T7751 temper or multiple step aging process of the type described in U.S. Pat. No. 3,305,410, titled HEAT TREATING OF ALUMINUM, issued Feb. 21, 1967, the contents of which are herein incorporated by reference. More particularly, samples of the alloy in W51 temper were heated at a controlled rate to 890° F. (477° C.), held for 3 hours, cooled to a lower temperature of 860° F. (468° C.), held at the lower temperature for 6 hours, and then cold water quenched. The quenched samples were then subjected to a multi-step artificial aging practice. More specifically, the samples were heated at a controlled rate to a temperature below about 360° F. (182° C.), for instance, within a first range of between about 340° F. to 360° F. (171°–182° C.), more preferably a range of between about 345° F. and about 355° F. (174°–179° C.). The samples were held within the first temperature range for time periods between about 70 minutes and 200 minutes. The samples were then air cooled to ambient, followed by heating at a controlled rate to a second aging temperature less than about 300° F. (149° C.). Alternatively, the samples could be cooled from the first temperature range directly to a temperature within the second temperature range, such as 250° F. (121° C.). The second temperature range preferably extends from 225° F. to 300° F. (107°–149° C.), or less. The product is held within the second temperature range for an appropriate time, such as more than 10 hours, and then cooled to ambient. When the product is aged in the first step for time periods of less than 150 minutes, it meets or exceeds the specifications for T7751 wrought products. The two step solution heat treating process of the present invention provides an improvement in the process for making T7751 Temper products in that the aging practice tolerances are not as stringent and higher ultimate tensile and yield strengths are possible.

As such, an invention has been disclosed in terms of preferred embodiments thereof which fulfill each and every one of the objects of the present invention as set forth herein above and provides a new and improved method of producing an AA7000 series alloy having improved exfoliation corrosion resistance and a product therefrom.

Of course, various changes, modifications and alterations from the teaching of the present invention may be contemplated by those skilled in the art without departing from the intended spirit and scope thereof. Accordingly, it is intended that the present invention only be limited by the terms of the appended claims.

What is claimed is:

1. In a method of producing an AA7000 series aluminum alloy wrought product by providing an AA7000 series alloy, working the alloy into a wrought product, solution heat treating the wrought product, quenching and aging the wrought product, the improvement comprising the step of: solution heat treating the wrought product in two steps after the alloy has been worked into the wrought product, a first step comprising heating the wrought product to a temperature within a first temperature range of about 885° to 910° F. (474°–488° C.) and holding the wrought product within the first temperature range for at least about three hours, a second step comprising heating the wrought product to a temperature within a second temperature range of about 825° to 870° F. (441°–466° C.) and holding the wrought product within the second temperature range for at least about 6 hours, the use of the two step solution heat treating improving the exfoliation corrosion resistance of the wrought product.

2. In a method of producing an AA7000 series aluminum alloy plate by providing an AA7000 series alloy, working the alloy into a plate, solution heat treating the plate, quenching and aging the plate, the improvement comprising the step of solution heat treating the plate in two steps after the alloy has been worked into the plate, a first step comprising heating the plate to a temperature within a first temperature range of about 885° to 910° F. (477°–488° C.) and holding the plate within the first temperature range for at least about 3 hours, a second step comprising heating the plate at a temperature within a second temperature range of about 825° to 870° F. (441°–466° C.), and holding the plate within the second temperature range for at least about 6 hours, the use of the two step solution heat treat improving the exfoliation corrosion resistance of the plate.

3. The method of claim 1 wherein the AA7000 series aluminum alloy is an AA7150 aluminum alloy.

4. The method of claim 1 wherein the second step comprises heating the wrought product to one of about 825° F. (441° C.), about 860° F. (460° C.) and about 870° F. (466° C.).

5. The method of claim 2 wherein the plate is held within the first temperature range for at least about 8 hours.

6. The method of claim 2 wherein the two step solution heat treating provides a plate having grain boundary precipitates which are larger in size than precipitates formed during solution heat treating the plate in a single step.

7. The method of claim 2 wherein the plate is held within the second temperature range for not more than about 15 hours.

8. The method of claim 2 wherein said plate is cold water quenched following said holding within the second temperature range.

9. The method of claim 8 wherein said plate is cold water quenched prior to the second step.

10. The method of claim 6 wherein the larger grain boundary precipitates are primarily copper-bearing.

11. The method of claim 1 wherein the wrought product is held within the first temperature range from about 3 to 8 hours and is held within the second temperature range from about 6 to 24 hours.

12. In a method of producing an AA7000 series aluminum alloy wrought product in the T7751 Temper by providing an AA7000 series alloy, working the alloy into a wrought product, solution heat treating the wrought product, quenching the wrought product and aging the wrought product in multiple steps to provide a product in the T7751 Temper, the improvement comprising the step of solution heat treating the wrought product in two steps after the alloy has been worked into the wrought product, a first step comprising heating the wrought product to a temperature within a first temperature range of about 885° to 910° F. (474°–488° C.) and holding the wrought product within the first temperature range for at least about 3 hours, a second step comprising heating the wrought product at a temperature within a second temperature range of about 825° to 870° F. (441°–466° C.), and holding the wrought product within the second temperature range for at least about 6 hours, the two step heat treating providing an improved process for making the T7751 Temper product.

13. The method of claim 1 further comprising cooling the wrought product after completion of the first step from a temperature within the first temperature range to a temperature within the second temperature range to thereby start the second step.

14. The method of claim 1 further comprising quenching the wrought product after completion of the first step to a temperature below the second temperature range, followed by heating the wrought product to a temperature within the second temperature range to thereby start the second step.

15. The method of claim 2 further comprising cooling the plate after completion of the first step from a temperature within the first temperature range to a temperature within the second temperature range to thereby start the second step.

16. The method of claim 2 further comprising quenching the plate after completion of the first step to a temperature below the second temperature range, followed by heating the plate to a temperature within the second temperature range to thereby start the second step.

17. The method of claim 12 further comprising cooling the wrought product after completion of the first step from a temperature within the first temperature range to a temperature within the second temperature range to thereby start the second step.

18. The method of claim 12 further comprising quenching the wrought product after completion of the first step to a temperature below the second temperature range, followed by heating the wrought product to a temperature within the second temperature range to thereby start the second step.

* * * * *